United States Patent [19]

Nazinin et al.

[11] 3,993,546

[45] Nov. 23, 1976

[54] SHAFT FURNACE FOR THERMOLYTIC DISTILLATION OF HYDROCARBON FUEL

[76] Inventors: Nikolai Andreevich Nazinin, ulitsa Vyidu, 12, kv. 30; Leonid Semenovich Ananiev, ulitsa Komsomoli, 15, kv. 12; Ivar Kharaldovich Roox, ulitsa Komsomoli, 27, kv. 24; Viktor Mikhailovich Efimov, ulitsa Vyidu, 4, kv. 5, all of Estonskaya SSR, Kokhtla-Yarve, U.S.S.R.

[22] Filed: May 2, 1975

[21] Appl. No.: 573,998

[52] U.S. Cl. ..... 202/99; 196/111; 196/115; 202/208; 202/270; 432/95

[51] Int. Cl.[2] ..... C10B 3/00; F27D 5/00

[58] Field of Search ..... 202/99, 108, 208, 270, 202/96; 201/34, 36, 40; 432/95, 97, 99; 110/31; 122/5; 208/11 R; 196/111, 115

[56] References Cited

FOREIGN PATENTS OR APPLICATIONS 158,394 2/1921 United Kingdom ..... 202/108

*Primary Examiner*—Morris O. Wolk
*Assistant Examiner*—Bradley Garris
*Attorney, Agent, or Firm*—Lackenbach, Lilling & Siegel

[57] ABSTRACT

A shaft furnace for the thermolytic distillation of solid hydrocarbon fuel comprises a vertically disposed cylindrical casing whose upper part accommodates at least two vertical gratings which divide the casing into a heat carrying distributing chamber, a semi-coking chamber and a vapor-gas mixture chamber with a gasification chamber located underneath the three above-mentioned chambers. The lowermost edge of at least one of the gratings is provided with opposing cutouts such that the middle section of the edge is substantially lower than the sides of the edge adjoining the casing. In this manner, the solid fuel is more evenly distributed in the gasification chamber and a more uniform distillation of the fuel is achieved.

6 Claims, 10 Drawing Figures

SHAFT FURNACE FOR THERMOLYTIC DISTILLATION OF HYDROCARBON FUEL

The present invention relates to fuel industry and more particularly it relates to shaft furnaces for thermolytic distillation of solid hydrocarbon fuel.

Known in the previous art is a shaft furnace for thermolytic distillation of solid hydrocarbon fuel comprising a cylindrical casing whose upper part accommodates two vertical gratings which divide said casing into a heat carrier distributing chamber formed by the side wall of the casing and one of the vertical gratings, a semi-coking chamber formed by the vertical gratings and the casing walls and merging into a gasification chamber located underneath, a vapour-gas mixture chamber formed by the other vertical grating and the side wall of the casing, blast and solid fuel admission means and means for discharging the vapour-gas mixture and solid waste.

However, a disadvantage of the known shaft furnace for thermolytic distillation of solid hydrocarbon fuel resides in that the velocity of the solid fuel along the cross section of the semi-coking chamber is nonuniform, being considerably higher in the near-axis zone than at the casing walls.

The nonuniformity of the fuel velocity along the cross section of the semi-coking chamber is caused by more constrained conditions of movement near the walls of the furnace casing, by friction of the material against the casing walls and by the geometric shape of the gasification chamber and lower edges of the vertical gratings.

It is an established fact that the filtration speed of the gas heat carrier through the layer of the bulk solid material is considerably higher near the side walls than in the other space due to the so-called wall effect.

Such a distribution of velocities of the solid fuel and gas heat carrier causes an undesirable distribution of heat. The fuel in the middle zone of the chamber is incompletely processed while near the casing walls it is overheated. This reduces the furnace output and the thermal efficiency of the process.

Often it happens that overheating of fuel leads to the formation of slag excrescences on the casing walls which cause hanging up of the handled fuel and interferes with the due course of the process as a whole.

This disadvantage is also inherent to other known furnaces of the same application.

An object of the present invention is to eliminate the aforesaid disadvantages.

Another object of the present invention is to provide a shaft furance for thermolytic distillation of solid hydrocarbon fuel whose construction provides uniform movement of the processed solid fuel along the cross section of the semi-coking chamber.

These objects are accomplished by providing a shaft furnace for thermolytic distillation of solid hydrocarbon fuel comprising a vertically disposed cylindrical casing whose upper part accommodates at least two vertically disposed gratings which divide the casing into a heat carrier distributing chamber formed by the side wall of the casing and one of the vertical gratings, a semi-coking chamber formed by the vertical gratings and the side wall of the casing and merging into a gasification chamber located underneath, a vapour-gas mixture chamber formed by the other vertical grating and a side wall of the casing, as well as a means for admitting gas into the gasification chamber, a means for discharging the vapour-gas mixture and means for feeding solid fuel into the upper part of the semi-coking chamber and discharging the solid semi-coked waste from the lower part of the gasification chamber wherein, according to the invention, the lower part of at least one vertical grating is provided with means in the nature of cutouts made in such a manner that the middle portion of the edge of the vertical grating is arranged lower than the edges of the cutouts on the sides of the vertical grating adjoining the side walls of the casing.

In the shaft furnace for thermolytic distillation of solid hydrocarbon fuel according to the invention equalization of the fuel velocity along the cross section of the semi-coking chamber ensures better conditions for heat and mass exchange between the gas heat carrier and the processed fuel which improves the efficiency of the furnace and the quality of fuel processing and raises the thermal efficiency of the process.

Now the invention will be described in detail by way of example with reference to the accompanying drawings in which.

Figures 1, 2, 3, 4, 5, 6:
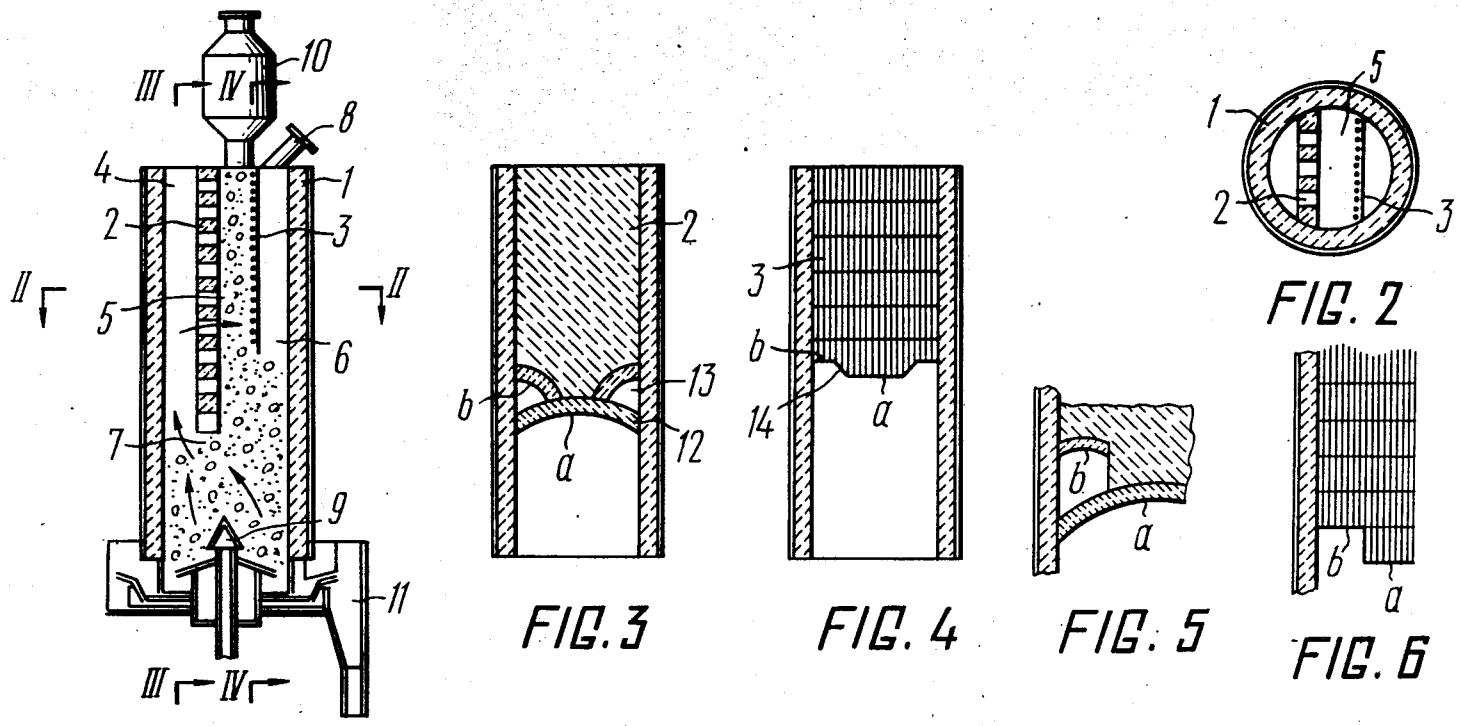
FIG. 1 is a schematic section through the shaft furnace for thermolytic distillation of solid hydrocarbon fuel according to the invention.
FIG. 2 is a section taken along line II—II in FIG. 1.
FIG. 3 is a section taken along line III—III in FIG. 1.
FIG. 4 is a section taken along line IV—IV in FIG. 1.
FIG. 5 shows schematically a probable version of the cutout of the hot vertical grating of the shaft furnace for thermolytic distillation of solid hydrocarbon fuel according to the invention.
FIG. 6 shows schematically a probable version of the cutout of the shaft cold vertical grating of the furnace for thermolytic distillation of solid hydrocarbon fuel according to the invention.

The shaft furnace for thermolytic distillation of solid hydrocarbon fuel consists of a casing 1 shown to be vertically disposed and cylindrical in FIGS. 1 and 2. The upper part of the casing 1 accommodates two vertically disposed gratings one of which, namely the hot vertical grating 2, is made of a refractory material while the second one, namely the cold vertical grating 3, is of heat-resistant steel.

The vertical gratings 2 and 3 divide the upper part of the casing 1 into three chambers: a heat carrier distributing chamber 4 formed by the side walls of the casing 1 and by the hot vertical grating 2; a semi-coking chamber 5 formed by the vertical grating 2, the cold vertical grating 3 and the side walls of the casing 1; a vapour-gas mixture chamber 6 formed by the cold vertical grating 3 and the side walls of the casing 1. Located in the lower part of the casing 1 under the heat carrier distributing, semi-coking and vapour-gas mixture chambers 4, 5 and 6 is a gasification chamber 7.

The vapour-gas mixture chamber 6 is provided with a means 8 for discharging the vapour-gas mixture while the gasification chamber 7 is provided with a means 9 for the admission of blast. The upper part of the casing 1 comprises a means 10 for the supply of solid fuel while its lower part has a means 11 for discharging the solid waste. The hot vertical grating 2 (FIG. 3) is secured on an arch 12 and is provided with means in the nature of opposing cutouts 13 adjoining the casing 1. The cold vertical grating 3 (FIG. 4) is secured to the walls of the casing 1 and is provided with means in the nature of opposing cutouts 14 adjoining the casing 1. The desirable configuration of the cutouts is illustrated in the drawing. However, it can be altered in the interests of better manufacturing technology.

The middle portion of edges *a* (FIGS. 3 and 4) of the hot and cold vertical gratings 2 and 3 are located considerably lower then the edges *b* of the cutouts on the sides of the vertical gratings 2 and 3 adjoining the side walls of the casing 1.

A possible embodiment of cutouts on the hot vertical grating 2 appears in FIG. 5 while the cutouts on the cold vertical grating 4 are shown in FIG. 6. The cutouts 13 (FIG. 3) of the hot vertical grating 2 and the cutouts 14 (FIG. 4) of the cold vertical grating 3 serve at least for equalizing the velocity of the material along the cross section or, at best, for increasing it at the side walls of the casing 1.

The furnace operates as follows. By coordinating the functioning of the means 10 supplying the solid hydrocarbon fuel and the means 11 for discharging the solid semi-coked waste (FIG. 1) it is possible to set the required output. In this case the processed solid hydrocarbon fuel moves from above downwards through the semi-coking chamber 5 and gasification chamber 7.

The means 9 admits the air blast which is required for the thermolytic distillation of solid fuel. The heat liberated during gasification of solid fuel in the gasification chamber 7 is conveyed by the gas heat carrier.

The gas heat carrier moves from the gasification chamber 7 into the heat carrier distributing chamber 4, passes through the holes in the hot vertical grating 2, is filtered in a crosswise direction through the layer of the processed solid fuel in the semi-coking chamber 5 and enters the vapour-gas mixture chamber 6 through the cold vertical grating 3. Filtration of gas heat carrier in a crosswise direction through the layer of the processed solid fuel is accompanied by heat and mass exchange between them, this leading to decomposition of the organic portion of the fuel. The products of thermal decomposition of the fuel take the form of a vapour-gas mixture, enter the vapour-gas mixture chamber 6 and are directed into the condensing system (not shown in the drawing) through the means 8 for discharging the vapour-gas mixture.

The cutouts 13 (FIG. 3) of the hot vertical grating 2 and the cutouts 14 (FIG. 4) of the cold vertical grating 3 provide the required uniformity of the velocity of the processed solid fuel along the cross section of the semi-coking chamber 5 (FIG. 1).

To make the essence of the invention more apparent we shall dwell in more detail on the factors which cause the nonuniform movement of solid fuel in the semi-coking chamber of the known furnaces for thermolytic distillation of solid hydrocarbon fuel in a crossflow of heat carrier.

Figure 7:
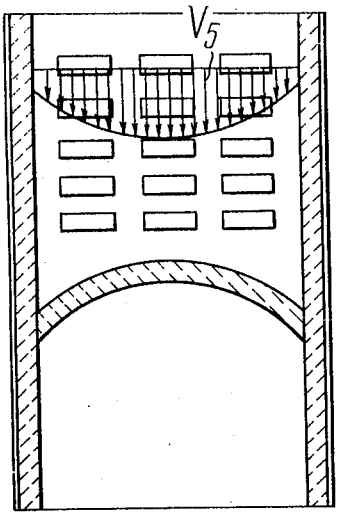
FIG. 7 is an approximate diagram of velocities of the processed fuel in the semi-coking chamber of the known furnaces for thermolytic distillation of solid hydrocarbon fuel.

It should be noted that in order to satisfy the requirements of strength, ease of production and economy of materials, the casing of the known furnaces is made cylindrical which constitutes the basic cause of the nonuniform velocity of the processed solid fuel along the cross section of the semi-coking chamber (an approximate velocity diagram is shown in FIG. 7).

The effect of the geometric shape of the gasification chamber and lower edges of the vertical gratings on the non-uniformity of velocity of the processed solid fuel can be explained with a certain degree of approximation as follows.

Figure 8:
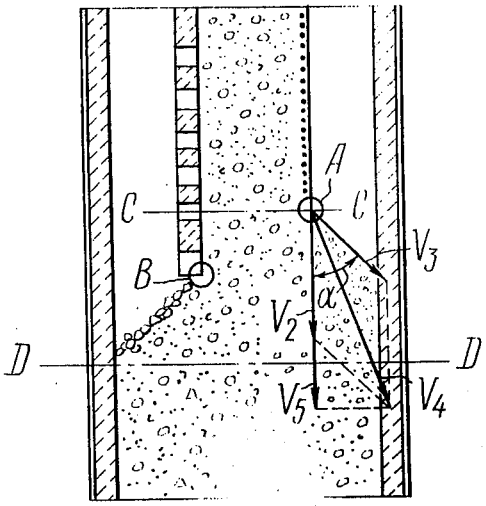
FIG. 8 is an approximate plan of velocities of a particle of solid fuel as it is discharged into the expanding space of the gasification chamber of the furnace for thermolytic distillation of solid hydrocarbon fuel.

Let us consider jointly the cross section of the semi-coking chamber in plane C—C (FIG. 8) and of the gasification chamber in plane D—D. Assuming that the rate of flow and the velocities at these sections are constant we can write $$V_1 \cdot f_1 = V_2 \cdot f_2 \qquad 1.$$

where $V_1$ — velocity of fuel in the semi-coking chamber;
$V_2$ — velocity of fuel in the gasification chamber;
$f_1$ — cross section of the semi-coking chamber;
$f_2$ — cross section of the gasification chamber.

From equation (1) it follows that $$V_1 = V_2\,(f_2/f_1) \qquad 2.$$

Equation (2) is true if we neglect the geometrical factors.

However, the flow below the section in plane C—C changes its form due to expansion.

Let us consider the movement of a particle of solid fuel at the lower edge of the vertical grating (zone A).

In this zone the particles of solid fuel move down along the vertical axis at a speed $V_2$ and are simultaneously discharged from under the edge of the vertical grating at a certain discharge speed $V_3$ directed at the angle of repose. The resultant veloctiy will be:

$$\vec{V}_4 = \vec{V}_2 + \vec{V}_3$$

The vertical component of the resultant velocity will be $$V_5 = V_2 + V_3 \cdot \cos\alpha \qquad 3.$$

where: $\alpha$ = angle of repose.

Figure 9:
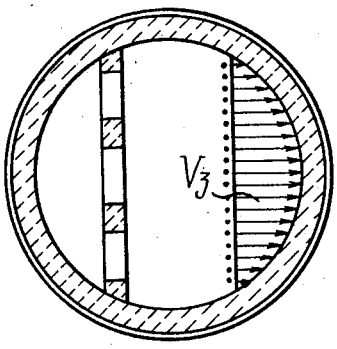
FIG. 9 is an approximate diagram of velocities at which a particle of solid fuel is discharged into the expanding space of the gasification chamber of the known furnaces for thermolytic distillation of solid hydrocarbon fuel.

If we assume that the flow rates along the elementary sections are equal, it becomes clear that the discharge speed $V_3$ is proportional to the distance along a perpendicular line from the vertical grating to the casing wall. Thus, the outline of the discharge velocity $V_3$ diagram will be similar to the cross outline of the zone into which the discharge is directed. This diagram illustrated in FIG. 9 shows that $V_3$ is maximum in the middle and is equal to zero in the zone where the grating adjoins the furnace casing. Then it follows from equation (3) that the vertical component of the fuel velocity $V_5$ along the cross section of the semi-coking chamber will be non-uniform, being greatest in the middle and lowest at the walls of the furnace casing.

A similar condition exists at the lower edge of the hot vertical grating (zone B).

If the furnace casing is rectangular in cross section, the discharge speed $V_3$ will not be nonuniform; however, due to a greater constraint the velocity of the prosessed solid fuel at the walls of the furnace casing will be somewhat lower than in the middle.

The uniform velocity of the processed solid fuel in the semi-coking chamber 5 of the furnace for thermal processing of solid fuel in a crossflow of heat carrier according to the invention is achieved as follows.

Figure 10:
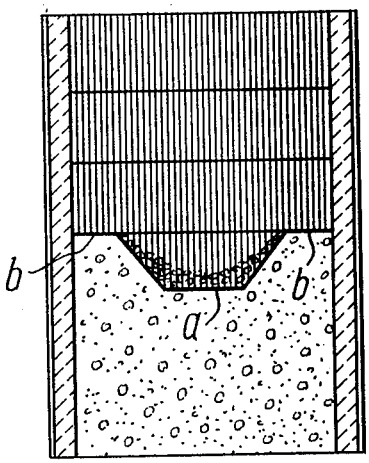
FIG. 10 shows an approximate arrangement of the slopes of the material on the surface of the vertical grating of the shaft furnace for thermolytic distillation of solid hydrocarbon fuel according to the invention.

Inasmuch as the middle portions of the edges *a* (FIG. 3 and 4) of the hot and cold vertical gratings 2 and 3 are located considerably lower than the edges *b* of the cutouts 13 and 14 on the sides of the vertical gratings 2 and 3 adjoining the side walls of the casing 1, the discharge into the expanding space of the gasification chamber 7 begins in the first place at the sides of the vertical gratings 2 and 3 from under the upper edges *b* of the cutouts 13 and 14. In this case the processesd solid fuel disperses in all possible directions including the direction along the vertical gratings 2 and 3, retarding the discharge of fuel from the middle lower portions of the edges *a* of the vertical gratings 2 and 3 in the zone where they are covered by the natural repose of the fuel. FIG. 10 shows for convenience that the lower part of the edge of the vertical grating is completely covered by the natural repose of the fuel.

If $V_2 =$ const. in equation (3), the value $V_3 \cdot \cos \alpha$ will be at a maximum in the zone of the cutouts. Accordingly, the vertical component of velocity $V_5$ will be greatest in the zone of the cutouts, i.e. at the walls of the casing 1.

Thus, the velocity of the processed solid fuel can be either equalized along the cross section of the semi-coking chamber 5 or increased near the walls of the casing 1 as compared with the remaining space, which was accomplished on a transparent model.

At a high velocity of material in the semi-coking chamber 5 near the side walls of the furnace casing 1 with an account taken of the wall effect during the flow of the gas heat carrier in the near-wall zone, the heat balance between the gas heat carrier and the processed solid fuel is brought to normal, the standard of fuel processing is improved and, in addition, the furnace output and the thermal efficiency of the process are increased.

The process of movement and discharging into an expanding space is by far more complicated than described above. The mathematic description given above gives only an approximate idea of the actual process and is used only for simplifying the essence of the invention.

What is claimed is:

1. In a shaft furnace for thermolytic distillation of solid hydrocarbon fuel comprising: a vertically disposed, cylindrical casing; at least two vertically disposed gratings provided in the upper part of said casing such that the sides of said gratings are attached to said casing; a heat carrier distributing chamber formed by a side wall of the casing and one of said gratings; a semi-coking chamber formed by said gratings; a vapour-gas mixture chamber formed by the other of said gratings and a side wall of the casing; a gasification chamber located in the lower part of said casing under the heat carrier distributing, semi-coking and vapour-gas mixture chambers and communicating with said chambers; means for admitting heating gas into said heat carrier distributing chamber; means for discharging the vapour-gas mixture from said vapour-gas mixture chamber; means for feeding solid fuel into the upper part of said semi-coking chamber; and means for discharging solid semi-coked waste from the lower part of the gasification chamber; the improvement comprising: wherein the lowermost edge of at least one of said gratings is provided with opposing cutouts adjacent the sides of the casing, whereby the resulting dependent, central section in conjuction with the cutouts of said at least one of said gratings constitutes means for more evenly distributing the solid fuel in the gasification chamber and for more uniformly distilling the solid fuel.

2. In a shaft furnace as defined in claim 1, including the further improvement wherein said cut-outs define an arcuate profile.

3. In a shaft furnace as defined in claim 1, including the further improvement wherein said cut-outs define a rectangular profile.

4. In a shaft furnace as defined in claim 1, including the further improvement wherein said cut-outs define a trapezoidal profile.

5. In a shaft furnace as defined in claim 1, including the further improvement wherein said cut-outs are provided on each of said at least two gratings.

6. In a shaft furnace as defined in claim 5, including the further improvement wherein said cut-outs on each of said at least two gratings are dissimilar and define dissimilar profiles.

* * * * *